US010047596B2

(12) United States Patent
Joshi et al.

(10) Patent No.: US 10,047,596 B2
(45) Date of Patent: Aug. 14, 2018

(54) SYSTEM AND METHOD FOR DISPOSAL OF WATER PRODUCED FROM A PLURALITY OF WELLS OF A WELL-PAD

(71) Applicant: General Electric Company, Schenectady, NY (US)

(72) Inventors: Mahendra Ladharam Joshi, Katy, TX (US); Xuele Qi, Edmond, OK (US); Raymond Patrick Murphy, Waddell, AZ (US); Shyam Sivaramakrishnan, Edmond, OK (US)

(73) Assignee: General Electric Company, Schenectady, NY (US)

( * ) Notice: Subject to any disclaimer, the term of this patent is extended or adjusted under 35 U.S.C. 154(b) by 254 days.

(21) Appl. No.: 15/193,392

(22) Filed: Jun. 27, 2016

(65) Prior Publication Data

US 2017/0022796 A1 Jan. 26, 2017

Related U.S. Application Data

(60) Provisional application No. 62/195,814, filed on Jul. 23, 2015.

(51) Int. Cl.
*E21B 43/38* (2006.01)
*E21B 4/04* (2006.01)
(Continued)

(52) U.S. Cl.
CPC ..... *E21B 43/38* (2013.01); *E21B 4/04* (2013.01); *E21B 33/12* (2013.01); *E21B 34/06* (2013.01);
(Continued)

(58) Field of Classification Search
CPC ..... E21B 43/385; E21B 43/40; E21B 43/38; E21B 43/34
See application file for complete search history.

(56) References Cited

U.S. PATENT DOCUMENTS 4,296,810 A 10/1981 Price
4,913,630 A 4/1990 Cotherman et al.
(Continued)

FOREIGN PATENT DOCUMENTS

CA 2096888 A1 11/1993
CN 202417467 U 9/2012
(Continued)

OTHER PUBLICATIONS

Matthews et al., "Application of Downhole Oil/Water Separation Systems in the Alliance Field", SPE Health, Safety and Environment in Oil and Gas Exploration and Production Conference, SPE 35817, pp. 453-462, 1996, New Orleans, Louisiana.
(Continued)

*Primary Examiner* — Kipp Charles Wallace
(74) *Attorney, Agent, or Firm* — GE Global Patent Operation

(57) ABSTRACT

A system includes a downhole separator, a first pump, a second pump, a surface separator, a first tube, and a second tube. The downhole separator is disposed within a first wellbore of a well-pad and configured to generate hydrocarbon stream and water stream from a first production fluid received from first production zone. First pump is disposed within first wellbore and second pump is disposed within a second wellbore of the well-pad. The surface separator is coupled to first and second pumps and configured to receive hydrocarbon stream from downhole separator, using first pump and a second production fluid from second production zone, using second pump and generate oil and water rich stream. First tube is coupled to downhole separator and configured to dispose water stream in a first disposal zone. Second tube is coupled to surface separator and configured to dispose water rich stream in a second disposal zone.

25 Claims, 4 Drawing Sheets

(51) Int. Cl.

| | |
|---|---|
| ***E21B 33/12*** | (2006.01) |
| ***E21B 34/06*** | (2006.01) |
| ***E21B 43/12*** | (2006.01) |
| ***E21B 43/14*** | (2006.01) |
| ***E21B 47/10*** | (2012.01) |
| ***E21B 43/40*** | (2006.01) |

(52) U.S. Cl.
CPC ..... *E21B 43/128* (2013.01); *E21B 43/14* (2013.01); *E21B 43/385* (2013.01); *E21B 43/40* (2013.01); *E21B 47/10* (2013.01)

(56) References Cited

U.S. PATENT DOCUMENTS

| | | | | |
|---|---|---|---|---|
| 5,318,122 | A | 6/1994 | Murray et al. | |
| 5,423,387 | A | 6/1995 | Lynde | |
| 5,830,368 | A | 11/1998 | Peachey | |
| 5,857,519 | A | 1/1999 | Bowlin et al. | |
| 5,862,863 | A | 1/1999 | Swisher | |
| 5,915,477 | A * | 6/1999 | Stuebinger | E21B 43/20 166/245 |
| 5,965,086 | A | 10/1999 | Rose et al. | |
| 5,992,524 | A | 11/1999 | Graham | |
| 5,996,690 | A | 12/1999 | Shaw et al. | |
| 6,015,011 | A | 1/2000 | Hunter | |
| 6,033,567 | A | 3/2000 | Lee et al. | |
| 6,039,116 | A * | 3/2000 | Stevenson | E21B 43/16 166/105.5 |
| 6,068,053 | A * | 5/2000 | Shaw | E21B 43/121 166/267 |
| 6,070,661 | A | 6/2000 | Kennedy et al. | |
| 6,070,667 | A | 6/2000 | Gano | |
| 6,080,312 | A | 6/2000 | Bowers et al. | |
| 6,082,452 | A | 7/2000 | Shaw et al. | |
| 6,131,655 | A | 10/2000 | Shaw | |
| 6,173,774 | B1 | 1/2001 | Fox | |
| 6,189,613 | B1 | 2/2001 | Chachula et al. | |
| 6,189,616 | B1 | 2/2001 | Gano et al. | |
| 6,196,313 | B1 | 3/2001 | Simons | |
| 6,279,658 | B1 * | 8/2001 | Donovan | E21B 17/00 166/250.15 |
| 6,336,504 | B1 | 1/2002 | Alhanati et al. | |
| 6,457,522 | B1 | 10/2002 | Bangash et al. | |
| 6,547,003 | B1 | 4/2003 | Bangash et al. | |
| 6,845,821 | B2 | 1/2005 | Bouma et al. | |
| 7,147,788 | B2 | 12/2006 | Tveiten | |
| 7,420,183 | B2 | 9/2008 | Kaiser et al. | |
| 8,261,821 | B2 | 9/2012 | Hackworth et al. | |
| 8,327,941 | B2 * | 12/2012 | Hackworth | E21B 43/385 166/265 |
| 8,449,750 | B2 | 5/2013 | Hamid et al. | |
| 8,757,256 | B2 | 6/2014 | Li et al. | |
| 8,789,609 | B2 * | 7/2014 | Smith | E21B 43/129 166/372 |
| 8,997,870 | B2 | 4/2015 | McAllister et al. | |
| 2001/0047872 | A1 | 12/2001 | Roberts et al. | |
| 2002/0189807 | A1 | 12/2002 | Emanuele et al. | |
| 2003/0085185 | A1 * | 5/2003 | Kouba | B01D 17/0208 210/787 |
| 2004/0062140 | A1 | 4/2004 | Cadogan et al. | |
| 2010/0147511 | A1 | 6/2010 | Ollre | |
| 2010/0200513 | A1 * | 8/2010 | Cartier | B01D 17/0214 210/739 |
| 2011/0079388 | A1 * | 4/2011 | Cox | E21B 43/38 166/266 |
| 2011/0087476 | A1 | 4/2011 | Calvert et al. | |
| 2015/0204181 | A1 * | 7/2015 | Roth | E21B 43/20 166/250.01 |
| 2015/0218501 | A1 | 8/2015 | Kauling et al. | |

FOREIGN PATENT DOCUMENTS

| | | | |
|---|---|---|---|
| EP | 571771 | A2 | 12/1993 |
| WO | 2004053291 | A1 | 6/2004 |
| WO | 2005118771 | A2 | 12/2005 |
| WO | 2012005889 | A1 | 1/2012 |
| WO | 2014044612 | A1 | 3/2014 |
| WO | 2014058426 | A1 | 4/2014 |

OTHER PUBLICATIONS

Loginov et al., "Completion Design for Downhole Water and Oil Separation and Invert Coning", SPE Annual Technical Conference and Exhibition, SPE 38829, pp. 801-810, 1997, San Antonio, Texas.
Bowers et al., "Development of a Downhole Oilwater Separation and Reinjection System for Offshore Application", Offshore Technology Conference, SPE Prod. & Facilities, vol. 15, No. 2, pp. 115-122, 2000.
PCT Search Report and Written Opinion issued in connection with related PCT Application No. PCT/US2016/042005 dated Oct. 5, 2016.
PCT Search Report and Written Opinion issued in connection with corresponding PCT Application No. PCT/US2016/041439 dated Oct. 13, 2016.
PCT Search Report and Written Opinion issued in connection with related PCT Application No. PCT/US2016/042907 dated Oct. 13, 2016.
Joshi et al., U.S. Appl. No. 62/195,814, filed Jul. 23, 2015.
Joshi et al., U.S. Appl. No. 14/975,915, filed Dec. 21, 2015.
Joshi et al., U.S. Appl. No. 15/196,737, filed Jun. 29, 2016.
Joshi et al., U.S. Appl. No. 14/968,292, filed Dec. 14, 2015.
Tuohey et al., U.S. Appl. No. 62/149,813, filed Apr. 20, 2015.
Kjos et al., "Down-Hole Water-Oil Separation and Water Reinjection Through Well Branches", SPE Annual Technical Conference and Exhibition, Conference location: Dallas, Texas, pp. 689-701, Oct. 22-25, 1995.
Verbeek et al., "Downhole Separator Produces Less Water and More Oil", European Petroleum Conference, Conference location: The Hague, Netherlands, vol. No. 1, pp. 429-434, Oct. 20-22, 1998.
Alhoni et al., "Application of Downhole Oil-Water Separation: A Feasibility Study", SPE Asia Pacific Oil and Gas Conference and Exhibition, Jakarta, Indonesia, pp. 1-12, 2003.
Harding et al., "Horizontal Water Disposal Well Performance in a High Porosity and Permeability Reservoir", Journal of Canadian Petroleum Technology, vol. No. 43, Issue No. 11, pp. 21-31, Nov. 2004.
Qazi et al., "A neural network model predicting combined separation efficiency of compact axial cyclonic and gravity separator", Computer, Control and Communication, IC4, 2nd International Conference, Karachi, pp. 1-7, Feb. 7-18, 2009.
Zunce et al., "Study on the Flow Pattern of Downhole Oil-Water Separator with Different Inlet Patterns", Bioinformatics and Biomedical Engineering, ICBBE, 3rd International Conference, Beijing, pp. 1-4, Jun. 11-13, 2009.
International Search Report and Written Opinion issued in connection with corresponding PCT Application No. EP2016/057971 dated Jun. 10, 2016.
International Search Report and Written Opinion issued in connection with corresponding PCT Application No. PCT/US2016/038284 dated Aug. 30, 2016.

* cited by examiner

SYSTEM AND METHOD FOR DISPOSAL OF WATER PRODUCED FROM A PLURALITY OF WELLS OF A WELL-PAD

CROSS-REFERENCE TO RELATED APPLICATIONS

This patent application claims priority and benefit under 35 U.S.C. § 119(e) from U.S. Provisional Application No. 62/195,814 entitled "SYSTEM AND METHOD FOR WELL PARTITION AND DOWNHOLE SEPARATION OF WELL FLUIDS", filed on Jul. 23, 2015, which is incorporated by reference herein in its entirety.

BACKGROUND

Embodiments of the present invention relate to a hydrocarbon production system, and more particularly, to a system and method for disposal of water produced from multiple wells of a well-pad.

Non-renewable hydrocarbon fluids such as oil and gas are widely used in various applications for generating energy. Such hydrocarbon fluids are generally extracted from the hydrocarbon wells which extend below a surface of earth to a region where the hydrocarbon fluids are available. Generally, the hydrocarbon fluids are not available in a purified form and are available as a mixture of hydrocarbon fluids, water, sand, and other particulate matter together referred to as a well fluid. Such well fluids are filtered using different mechanisms to extract a hydrocarbon rich stream and a water stream.

In one approach, well fluids are extracted from a hydrocarbon well to a surface of the earth and then separated using a surface separator to produce oil and water. In such an approach, water separated from the well fluids are distributed and transported to a plurality of locations for disposal. However, such a process may increase capital investment and operational costs for water disposal.

In another approach, a downhole separator is used within the hydrocarbon well for separation of oil and water from well fluids. In such an approach, water separated from the hydrocarbon stream is disposed within the hydrocarbon well. The downhole separator is susceptible to scaling leading to reduction in efficiency. Further, operation of such a downhole separator may increase electric power consumption leading to additional operational costs.

Accordingly, there is a need for an enhanced system and method for disposal of water produced from a plurality of wells of a well-pad.

BRIEF DESCRIPTION

In accordance with one exemplary embodiment, a system for disposal of water produced from multiple wells of a well-pad is disclosed. The system includes a downhole separator, a plurality of pumps including a first pump and a second pump, a first surface separator, a first tube, and a second tube. The downhole separator is disposed within a first wellbore of the well-pad. The downhole separator is configured to receive a first production fluid from a first production zone and generate a hydrocarbon rich stream and a water stream from the first production fluid. The first pump is disposed within the first wellbore and coupled to the downhole separator. The second pump is disposed within a second wellbore of the well-pad. The first surface separator is coupled to the first pump via a first channel and to the second pump via a second channel. The first surface separator is configured to receive the hydrocarbon rich stream from the downhole separator, using the first pump and a second production fluid from a second production zone, using the second pump. The first surface separator is further configured to generate oil and a water rich stream from the hydrocarbon rich stream and the second production fluid. The first tube is coupled to the downhole separator and configured to dispose the water stream from the downhole separator in a first disposal zone. The second tube is coupled to the first surface separator and configured to dispose the water rich stream from the first surface separator in a second disposal zone.

In accordance with another exemplary embodiment, a method for disposal of water produced from multiple wells of a well-pad is disclosed. The method involves receiving a first production fluid from a first production zone to a downhole separator disposed within a first wellbore of the well-pad. The method further involves generating a hydrocarbon rich stream and a water stream from the first production fluid, using the downhole separator. Further, the method involves feeding the hydrocarbon rich stream from the downhole separator, using a first pump of a plurality of pumps, to a first surface separator via a first channel. The first pump is disposed within the first wellbore and coupled to the downhole separator. The method further involves feeding a second production fluid from a second production zone, using a second pump of the plurality of pumps, to the first surface separator via a second channel. The second pump is disposed within a second wellbore of the well-pad. Further, the method involves generating oil and a water rich stream from the hydrocarbon rich stream and second production fluid, using the first surface separator. The method further involves disposing the water stream from the downhole separator in a first disposal zone, using a first tube coupled to the downhole separator and disposing the water rich stream from the first surface separator in a second disposal zone, using a second tube coupled to the first surface separator.

DRAWINGS

These and other features and aspects of embodiments of the present invention will become better understood when the following detailed description is read with reference to the accompanying drawings in which like characters represent like parts throughout the drawings, wherein.

DETAILED DESCRIPTION

Embodiments of the present invention discussed herein relate to a system and method for disposal of water produced from a plurality of wells into a well-partition well. In one or more embodiments, the system functions as a closed loop system for disposal of produced water. In one embodiment, the system includes a downhole separator, a plurality of pumps including a first pump and a second pump, a first surface separator, a first tube, and a second tube. The downhole separator is disposed within a first wellbore of a first well (hereinafter also referred as "a downhole-separator well") of the well-pad. The downhole separator is configured to receive a first production fluid from a first production zone and generate a hydrocarbon rich stream and a water stream from the first production fluid. The first pump is disposed within the first wellbore and coupled to the downhole separator. The second pump is disposed within a second wellbore of a second well (hereinafter also referred as "a well-partition well") of the well-pad. The first surface separator is coupled to the first pump via a first channel and to the second pump via a second channel. The first surface separator is configured to receive the hydrocarbon rich stream from the downhole separator, using the first pump and a second production fluid from a second production zone, using the second pump. The first surface separator is further configured to generate oil and a water rich stream from the hydrocarbon rich stream and the second production fluid. The first tube is coupled to the downhole separator and configured to dispose the water stream from the downhole separator in a first disposal zone. The second tube is coupled to the first surface separator and configured to dispose the water rich stream in a second disposal zone. In such embodiments, the first disposal zone is located either below the first production zone or above the first production zone and second disposal zone is located above the second production zone.

Figure 1:
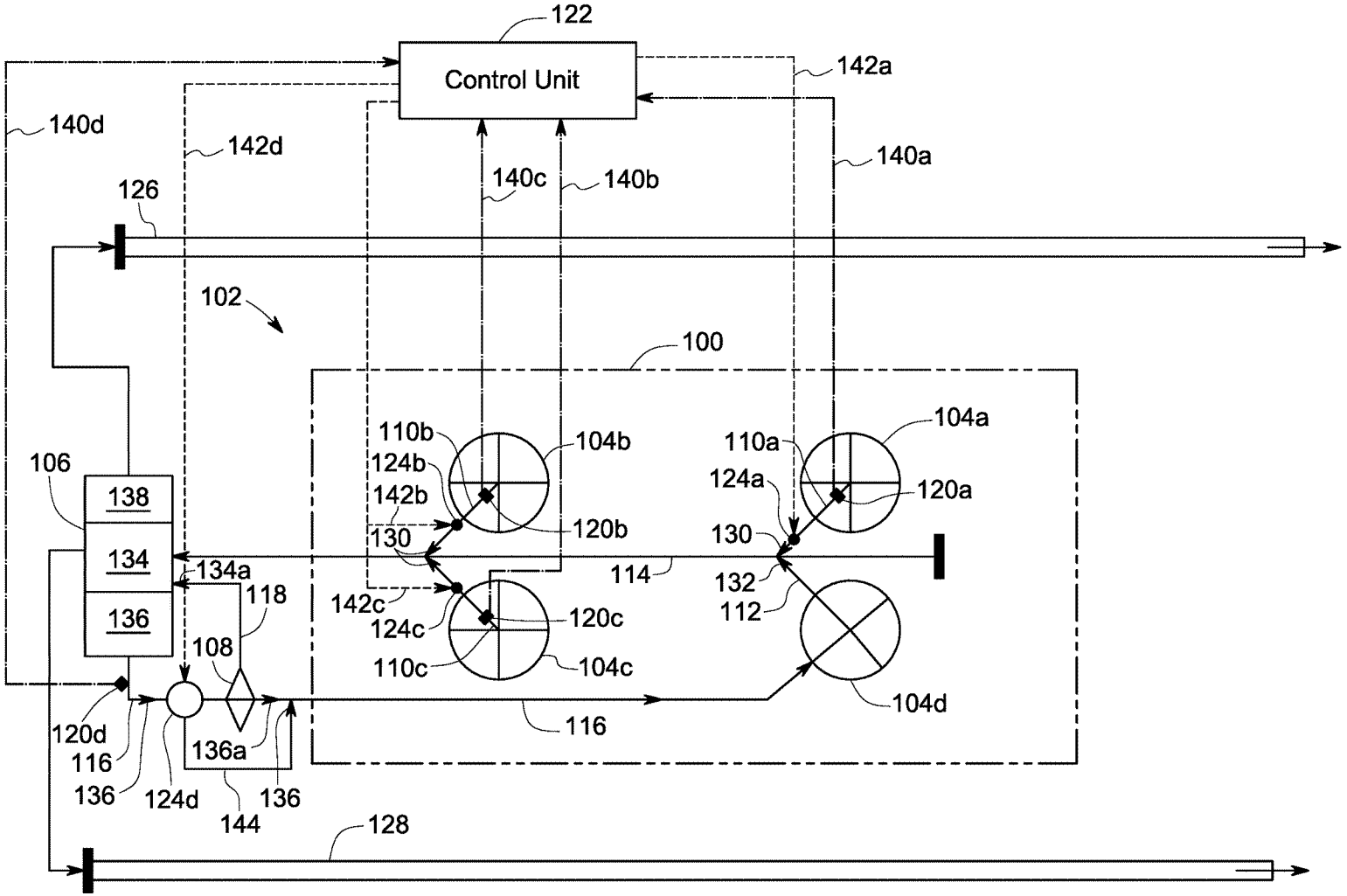
FIG. 1 is a schematic diagram of a well-pad having a plurality of wells and a system for separation of water in accordance with one exemplary embodiment.

FIG. 1 illustrates a schematic diagram of a well-pad 100 and a system 102 for disposal of water in accordance with one exemplary embodiment.

The well-pad 100 includes a plurality of wells 104*a*, 104*b*, 104*c* referred to as downhole-separator wells or first wells. The well-pad 100 further includes a well 104*d* referred to as a well-partition well or a second well. In one embodiment, each of the plurality of wells 104*a*-104*d* is a hydrocarbon well. It should be noted herein that the term "well-pad" is referred to the group of wells 104*a*-104*d* located within a cluster of a geological source which share common hydrocarbon fluid processing facilities. The number of wells of the well-pad 100 may vary depending on the application. It should be noted herein that the term "a well-partition well" is a hydrocarbon well which does not include a downhole separator disposed within the corresponding wellbore and includes a disposal zone located above a production zone. Similarly, the term "a downhole-separator well" is referred to a hydrocarbon well having a downhole separator disposed within the corresponding wellbore and the disposal zone located either above or below the production zone. In certain embodiments, each of the plurality of wells 104*a*-104*d* extends below a surface of earth to a region where the hydrocarbon fluids are available. Each of the plurality of wells 104*a*-104*d* is configured to produce a production fluid (hereinafter also referred to as "well fluid") which is a mixture of hydrocarbon fluids, water, sand, and other particulate matter.

The system 102 includes a plurality of downhole separators (not shown), a plurality of pumps (not shown), a first surface separator 106, a second surface separator 108, a plurality of first channels 110*a*, 110*b*, 110*c*, a second channel 112, an inlet manifold 114, a plurality of first tubes (not shown), a second tube 116, an oil stream tube 118, a plurality of sensors 120*a*, 120*b*, 120*c*, 120*d*, a control unit 122, and a plurality of control valves 124*a*, 124*b*, 124*c*, 124*d*. In such embodiments, each of the plurality of downhole separators, the plurality of pumps, and the plurality of first tubes are disposed within the corresponding wellbore of the plurality of wells 104-104*d*. The system 102 further includes a gas outlet manifold 126 and an oil outlet manifold 128.

The first surface separator 106 is coupled to the plurality of first channels 110*a*-110*c* and the second channel 112 via the inlet manifold 114. In one embodiment, the first surface separator 106 is a gravity-based separator. In some embodiments, the first surface separator 106 may be a heater-treater, a filtering device, or the like. In some other embodiments, the first surface separator 106 may be an active separator such as a centrifugal separator. In the illustrated embodiment, the first surface separator 106, the second surface separator 108, the plurality of sensors 120*a*-120*d*, and the plurality of control valves 124*a*-124*d* are disposed on a surface of earth. Further, the first surface separator 106 is coupled to the plurality of pumps via the corresponding plurality of first channels 110*a*-110*c* and the second channel 112. In certain embodiments, each of the sensors 120*a*-120*d* is density meter or a densometer.

During operation, each downhole separator is configured to generate a hydrocarbon rich stream 130 and a water stream (not shown) from a first production fluid (not shown) received from a first production zone. The first surface separator 106 is configured to receive the hydrocarbon rich stream 130 from the plurality of downhole-separator wells 104*a*-104*c* and a second production fluid 132 from the well-partition well 104*d*. Specifically, the first surface separator 106 is configured to receive the hydrocarbon rich stream from the corresponding downhole separator using the corresponding first pump and the second production fluid using the second pump. Further, the first surface separator 106 is configured to generate oil 134 and a water rich stream 136 from the hydrocarbon rich stream 130 and the second production fluid 132. The first surface separator 106 is also configured to separate a gaseous stream 138 from the hydrocarbon rich stream 130 and the second production fluid 132. In one specific embodiment, the constituents of the hydrocarbon rich stream 130 and second production fluid 132 are segregated based on density of each constituent. In the illustrated embodiment, the oil 134 is filled in a bottom section, the water rich stream 136 is filled in a middle section, and the gaseous stream 138 is filled in a top section of the first surface separator 106.

The sensors 120*a*-120*c* are coupled to the plurality of first channels 110*a*-110*c* respectively. The control valves 124*a*-124*c* are coupled to the plurality of first channels 110*a*-110*c* respectively. The control valves 124*a*-124*c* are disposed downstream relative to the plurality of sensors 120*a*-120*c* respectively. Further, the sensors 120*a*-120*c* and the control valves 124*a*-124*d* are communicatively coupled to the control unit 122.

During operation, each of the plurality of sensors 120*a*-120*c* is configured to measure a density of the hydrocarbon rich stream 130 in the corresponding first channels 110*a*-110*c*. Further, the sensors 120*a*-120*c* are configured to generate a plurality of signals 140*a*, 140*b*, 140*c*, respectively representative of the density of the hydrocarbon rich stream 130. The control unit 122 is configured to receive the signals 140*a*-140*c* from the plurality of sensors 120*a*-120*c* and determine an amount of water content in the hydrocarbon rich stream 130. Further, the control unit 122 is configured to generate a plurality of signals 142*a*, 142*b*, 142*c* to selectively regulate the control valves 124*a*-124*c* respectively to allow a flow of the hydrocarbon rich stream 130 through the corresponding first channels 110*a*-110*c* to the first surface separator 106. In one embodiment, the control unit 122 may determine the amount of water content in the hydrocarbon rich stream 130 by comparing obtained values of the plurality of signals 140*a*-140*c* with predefined values stored in a look-up table, database, or the like. In one embodiment, if the obtained value is less than the predefined value, the control unit 122 may allow continuous flow of the hydrocarbon rich stream 130 through the first channel 110*a*. In another embodiment, if the obtained value is greater than the predefined value, the control unit 122 may control an outlet pressure of the hydrocarbon rich stream 130 flowing through the first channel 110*a* by controlling the control valve 124*a*.

In one embodiment, if the amount of water content in the hydrocarbon rich stream 130 is greater than 30 parts per million (ppm), the control unit 122 is configured to control the outlet pressure of the hydrocarbon rich stream 130 flowing through the first channel 110*a* by controlling the control valve 124*a* based on at least one of the signals 140*a*-140*c*. As a result, the downhole separator disposed in the downhole-separator well 104*a* separates the water content from the first production fluid efficiently. In such embodiments, the sensors 120*a*, 120*b*, and 120*c*, along with control signals 142*a*, 142*b*, and 142*c* together with operation of the control valves 124*a*, 124*b*, and 124*c* and the control unit 122 enables the corresponding downhole separator to dispose the water stream having a residual oil content (hydrocarbon) of less of than 30 ppm in the corresponding disposal zone of the downhole separator wells 104*a*, 104*b*, and 104*c*. In another embodiment, if the amount of water content in the hydrocarbon rich stream 130 is less than or equal to 30 ppm, the control unit 122 may allow continuous flow of the hydrocarbon rich stream 130 through the first channel 110*a*.

The second tube 116 is coupled to the first surface separator 106, the second surface separator 108, and extends into the well-partition well 104*d*. Further, the second tube 116 extends proximate to a disposal zone (not shown) located in the well-partition well 104*d*. The sensor 120*d* and the control valve 124*d* are coupled to the second tube 116. The control valve 124*d* is disposed downstream relative to the sensor 120*d*. Further, the second surface separator 108 is disposed downstream relative to the control valve 124*d*. The sensor 120*d* and the control valve 124*d* are communicatively coupled to the control unit 122. In one embodiment, the second surface separator 108 is a coalescing filter. In some embodiments, the second surface separator 108 may be a media filter, a filter tube, or the like.

During operation, the second tube 116 is used to dispose the water rich stream 136 from the first surface separator 106 to a disposal zone located in the well-partition well 104*d*. The sensor 120*d* is configured to measure density of the water rich stream 136 in the second tube 116. Specifically, the sensor 120*d* is configured to generate a signal 140*d* representative of the density of the water rich stream 136. The control unit 122 is configured to receive the signal 140*d* from the sensor 120*d* and determine an amount of oil content in the water rich stream 136. Further, the control unit 122 is configured to generate a signal 142*d* to regulate the control valve 124*d* to allow a flow of the water rich stream 136 through the second tube 116 to the second surface separator 108. In one embodiment, the control unit 122 may determine the amount of oil content in the water rich stream 136 by comparing an obtained value from the signal 140*d* with a predefined value stored in a look-up table, database, or the like. In one embodiment, if the obtained value is less than the predefined value, the control unit 122 may control the control valve 124*d* to direct the water rich stream 136 via a bypass channel 144, bypassing the second surface separator 108 to the disposal zone. In another embodiment, if the obtained value is greater than the predefined value, the control unit 122 may stop direct transfer of the water rich stream 136 to the disposal zone, using the control valve 124*d* and transfer at least a portion of the water rich stream 136 from the first surface separator 106 to the second surface separator 108.

In one embodiment, if the amount of oil content in the water rich stream 136 is greater than 30 parts per million (ppm), the control unit 122 may stop direct transfer of the water rich stream 136 to the disposal zone, using the control valve 124*d*. Further, the control unit 122 may transfer at least the portion of the water rich stream 136 from the first surface separator 106 to the second surface separator 108, using the control valve 124*d*. The second surface separator 108 is configured to further separate the oil content 134*a* from the water rich stream 136. The second surface separator 108 is further configured to transfer a separated water rich stream 136*a* to the disposal zone and the separated oil content 134*a* to the first surface separator 106 via the oil stream tube 118. In another embodiment, if the amount of oil content in the water rich stream 136 is less than or equal to 30 ppm, the control unit 122 may control the control valve 124*d* to direct the water rich stream 136 via the bypass channel 144, bypassing the second surface separator 108 to the disposal zone in well-partition well 104*d*.

The gas outlet manifold 126 is coupled to the top section of the first surface separator 106 and configured to transfer the gaseous stream 138 to a distant storage facility or production facility, or the like. The oil outlet manifold 128 is coupled to the middle section of the first surface separator 106 and is configured to transfer the oil 134 to a distant storage facility or production facility, or the like.

Figure 2:
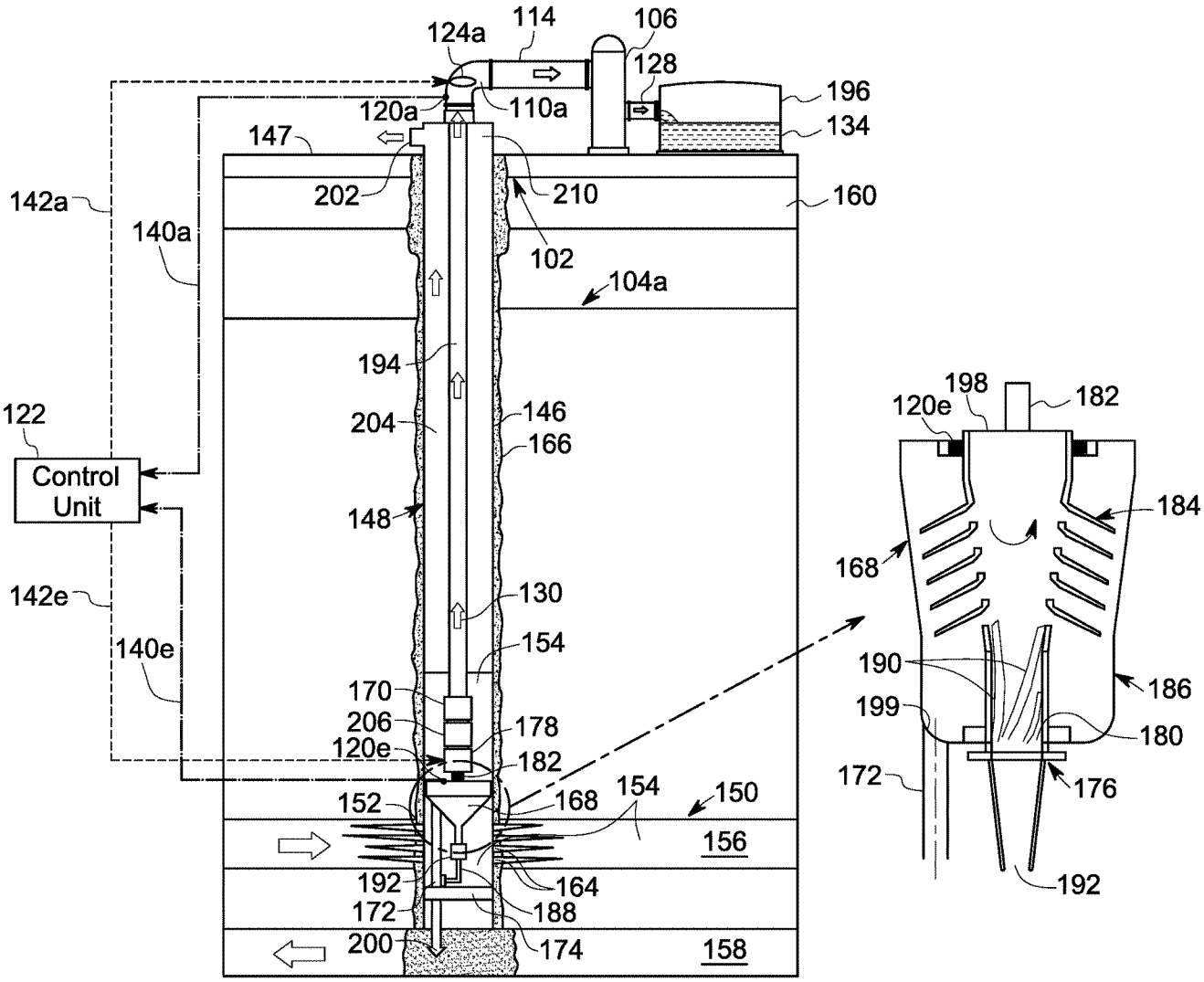
FIG. 2 is schematic diagram of a portion of the system disposed in a downhole-separator well of the plurality of wells in accordance with the exemplary embodiment of FIG. 1.

FIG. 2 illustrates a schematic diagram of a portion of the system 102 disposed in the downhole-separator well 104*a* in accordance with the exemplary embodiment of FIG. 1.

In one embodiment, the downhole-separator well 104*a* includes a first wellbore 146 drilled from a surface 147 of the earth. The first wellbore 146 extends up to a predetermined depth, for example, about 6500 feet from the surface 147 to form a vertical leg 148. The downhole-separator well 104*a* also includes a lateral leg 150 which is coupled to the vertical leg 148 via a leg junction 152. The lateral leg 150 is configured to receive a first production fluid 154 from a first production zone 156. The downhole-separator well 104*a* further includes a first disposal zone 158 located below the first production zone 156 and a water zone 160 located below the surface 147 of the earth. In one embodiment, a portion of the first wellbore 146 proximate to the leg junction 152 includes a plurality of perforations 164 for extracting the first production fluid 154 from the first production zone 156 into the first wellbore 146. In the illustrated embodiment, cement 166 is affixed to a surface of the first wellbore 146.

The system 102 further includes a downhole separator 168, a first pump 170, a first tube 172, and a sensor 120*e*. It should be noted herein that in the illustrated embodiment, sensor 120*a* is also referred to as a "first sensor" and the sensor 120*e* is also referred to as a "second sensor". The system 102 further includes a packer 174, a jet pump 176, a motor 178, and a motive fluid tube 188.

The downhole separator 168 is disposed within the first wellbore 146 and proximate to the leg junction 152. The downhole separator 168 is a rotary separator such as a centrifugal separator including a plurality of rotating elements 184. The motor 178 is disposed within the first wellbore 146 and coupled to the downhole separator 168 and the first pump 170 via a shaft 182. Specifically, the motor 178 is coupled to the plurality of rotating elements 184 disposed within a casing 186 of the downhole separator 168. In one embodiment, the motor 178 is an electric motor powered by electricity supplied via a cable (not shown) from the surface 147 of the earth. In some other embodiments, the motor 178 may be a hydraulic motor. A hydraulic fluid (i.e. water) is supplied (not shown) from the surface 147 of the earth to the motor 178 via a tube (not shown). The jet pump 176 is disposed within the first wellbore 146 and coupled to an inlet 180 of the downhole separator 168. Specifically, the jet pump 176 is disposed proximate to the plurality of perforations 164. The jet pump 176 includes a plurality of fixed vanes 190 located around the inlet 180 of the downhole separator 168. The packer 174 is disposed within the first wellbore 146 and located upstream relative to the downhole separator 168. The motive fluid tube 188 is disposed within the first wellbore 146 and located downstream relative to the packer 174. The motive fluid tube 188 is coupled to the first tube 172 and to an inlet 192 of the jet pump 176. The first tube 172 is inserted through the packer 174 to the first disposal zone 158.

The first pump 170 is disposed within the first wellbore 146 and located downstream relative to the downhole separator 168. The first pump 170 is coupled to the motor 178. A gas separator 206 is disposed between the motor 178 and the first pump 170. The gas separator 206 is configured to separate the gaseous medium 204 from the first production fluid 154 before feeding the first production fluid 154 to the first pump 170. Further, the first surface separator 106 is directly coupled to the first pump 170 via a production tubing 194, the first channel 110*a*, and the inlet manifold 114. In the illustrated embodiment, the production tubing 194 is located within the first wellbore 146. The first channel 110*a* and the inlet manifold 114 are located at the surface 147 of the earth. The oil outlet manifold 128 coupled to the first surface separator 106 and to a distant storage facility such as an oil tank 196. The first sensor 120*a* and the control valve 124*a* are coupled to the first channel 110*a*. Specifically, the first sensor 120*a* is disposed upstream relative to the control valve 124*a*. The second sensor 120*e* is coupled to an outlet 198 of the downhole separator 168. In certain embodiments, the second sensor 120*e* may be disposed in a tube (not shown in FIG. 2) coupled to the outlet 198 of the downhole separator 168. Such a tube is used to feed the first production fluid 154 to the gas separator 206. In one embodiment, the second sensor 120*e* is a flow sensor. In some other embodiments, the second sensor 120*e* may a pressure sensor and the like. The control unit 122 is also communicatively coupled to the second sensor 120*e*, and the motor 178.

During operation, the vertical leg 148 receives the first production fluid 154 from the lateral leg 150. Specifically, the vertical leg 148 receives the first production fluid 154 from the first production zone 156 via the plurality of perforations 164. The jet pump 176 directs the first production fluid 154 to the downhole separator 168. Specifically, the plurality of fixed vanes 190 is configured to generate pre-swirl to the first production fluid 154 before feeding to the downhole separator 168. In other words, the jet pump 176 may be used to pressurize the first production fluid 154 prior to introducing to the downhole separator 168 to improve efficiency of the system 102.

The downhole separator 168 is configured to generate the hydrocarbon rich stream 130 and a water stream 200 from the first production fluid 154. Specifically, the motor 178 is configured to drive the downhole separator 168 so as to rotate plurality of rotating elements 184 at a predetermined speed to generate the hydrocarbon rich stream 130 and the water stream 200 from the first production fluid 154. During rotation of the downhole separator 168, hydrocarbons having a lower molecular weight are separated from water and other particulate matter having a higher molecular weight in the first production fluid 154. Further, the downhole separator 168 is configured to discharge the hydrocarbon rich stream 130 via the outlet 198 and the water stream 200 via an outlet 199 to the first tube 172.

The first tube 172 is used to dispose the water stream 200 from the downhole separator 168 to the first disposal zone 158. The motive fluid tubing 188 is used to transfer a portion of the water stream 200 to the inlet 192 of the jet pump 176 so as to create suction pressure at the inlet 192 of the jet pump 176. In one or more embodiments, the suction pressure at the inlet 192 aids in drawing the first production fluid 154 into the jet pump 176 from the first wellbore 146.

The gas separator 206 is configured to receive the separated hydrocarbon rich stream 130 from the downhole separator 168. In such embodiments, the gas separator 206 is configured to separate the gaseous medium 204 from the hydrocarbon rich stream 130 before feeding the hydrocarbon rich stream 130 to the first pump 170. Further, the gas separator 206 is configured to discharge the gaseous medium 204 to a portion of the first wellbore 146 above the first pump 170. The first pump 170 is configured to receive the separated hydrocarbon rich stream 130 from the downhole separator 168 via the gas separator 206. In one embodiment, the first pump 170, the gas separator 206, and the motor 178 are collectively referred to as an "artificial lift system". In such embodiments, the artificial lift system is an electrical submersible pump (ESP). In some other embodiments, the first pump 170 is a rod pump. The motor 178 is configured to drive the first pump 170 to transfer the hydrocarbon rich stream 130 to the first surface separator 106. In certain embodiments, a gear box (not shown) may be disposed between the downhole separator 168 and the first pump 170 and configured to vary the speed of the shaft 182. The first surface separator 106 is configured to receive the hydrocarbon rich stream 130 directly from first pump 170 and generate the oil 134 and the water rich stream 136 from the hydrocarbon rich stream 130. The oil 134 is transferred to the oil tank 196 via the oil outlet manifold 128. The water rich stream 136 is disposed in a second disposal zone of the well-head well via the second tube 116. A gas manifold 202 is disposed at the surface 147 of the earth and coupled to a wellhead 210 of the first wellbore 146. The gas manifold 202 is used to discharge a gaseous medium 204 collected within the first wellbore 146 to the discharge storage facility, a compressor, or the like.

The second sensor 120*e* is configured to measure a flow rate of the hydrocarbon rich stream 130. The second sensor 120*e* is configured to generate a second signal 140*e* representative of the flow rate of the hydrocarbon rich stream 130. The control unit 122 is configured to receive at least one of the first signal 140*a* and the second signal 140*e* from the first sensor 120*a* and the second sensor 120*e* respectively. As discussed earlier, in one embodiment, the control unit 122 is configured to generate the signal 142*a* to regulate the control valve 124*a* to control an outlet pressure of the hydrocarbon rich stream 130 flowing via the first channel 110*a* to the first surface separator 106. In some other embodiments, the control unit 122 is configured to generate a signal 142*e* and transmit the signal 142*e* to the motor 178 to control a speed of the motor 178 based on at least one of the first signal 140*a* and the second signal 140*e*. In one or more embodiments, the control unit 122 may determine the amount of water content in the hydrocarbon rich stream 130 by comparing obtained values in the first signal 140*a* and the second signal 140*e* with predefined values stored in a look-up table, database, or the like.

Figure 3:
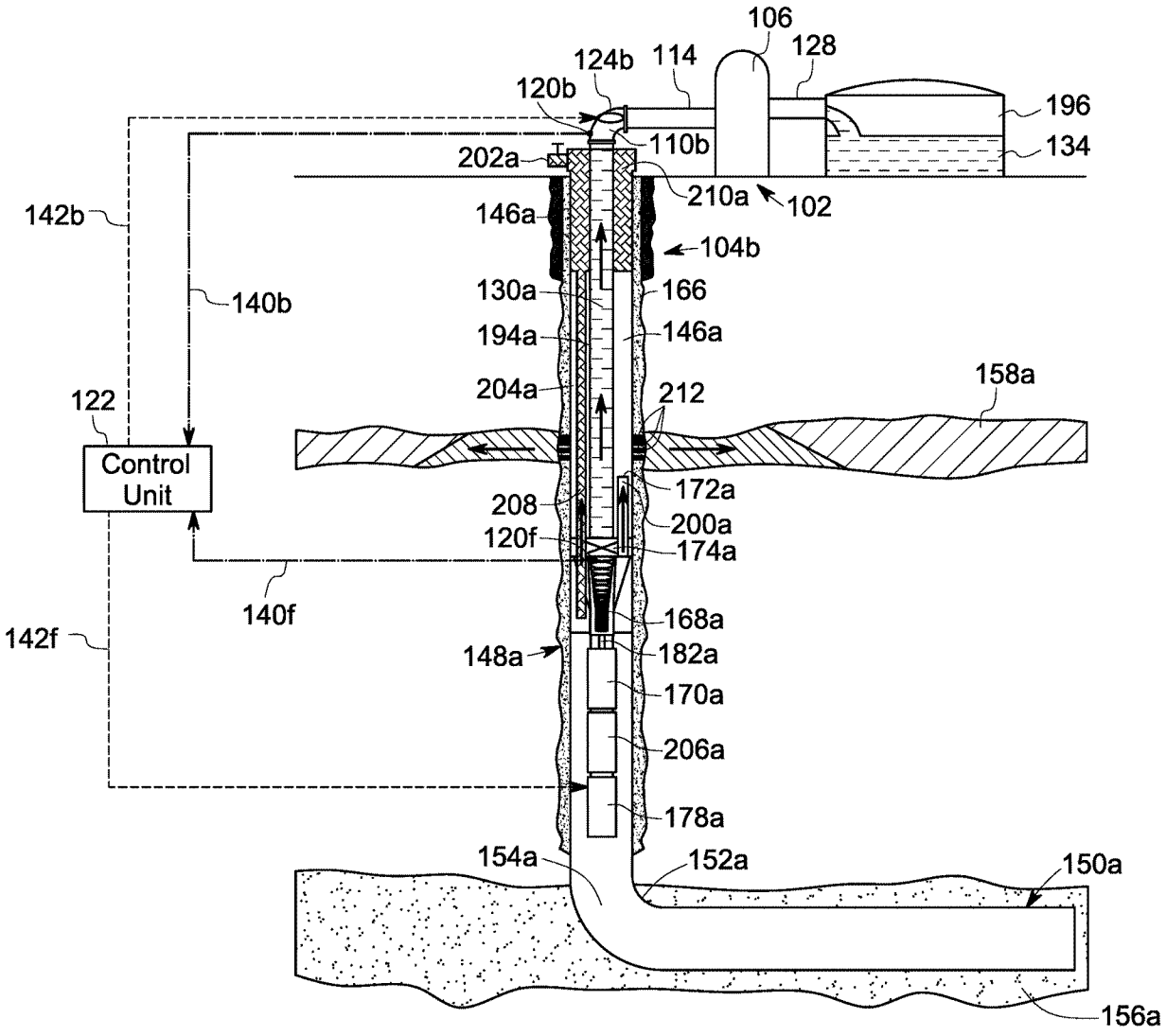
FIG. 3 is schematic diagram of another portion of the system disposed in another downhole-separator well of the plurality of wells in accordance with the exemplary embodiments of FIGS. 1 and 2.

As discussed, in the embodiments of FIGS. 1 and 3, the plurality of control valves 124*a*-124*d* may include hydraulic choke valves or electronic regulator valves. The control unit 122 may be a processor-based device. In some embodiments, the control unit 122 may include a proportional-integral-derivative (PID) controller which may be integrated within each of the control valve 124*a*-124*d*. In some other embodiments, the control unit 122 may be a general purpose processor or an embedded system. The control unit 122 may be operated via an input device or a programmable interface such as a keyboard or a control panel. A memory module of the control unit 122 may be a random access memory (RAM), read only memory (ROM), flash memory, or other type of computer readable memory accessible by the control unit 122. The memory module of the control unit 122 may be encoded with a program for controlling the plurality of control valves 124*a*-124*d* based on various conditions at which the each of the plurality of control valves 124*a*-124*d* is defined to be operable.

FIG. 3 is schematic diagram of another portion of the system 102 disposed in the downhole-separator well 104*b*-104*d* in accordance with the exemplary embodiments of FIGS. 1 and 2.

The downhole-separator well 104*b* includes a first wellbore 146*a* having a vertical leg 148*a* and a lateral leg 150*a* coupled to the vertical leg 148*a* via a leg junction 152*a*. The lateral leg 150*a* is used to transfer a first production fluid 154*a* from a first production zone 156*a* to the vertical leg 148*a* via a plurality of perforations (not shown) formed in at least one of the lateral leg 150*a* proximate to the leg junction 152*a*. In the illustrated embodiment, the downhole-separator well 104*b* further includes a first disposal zone 158*a* located above the first production zone 156*a*. Cement 166 is affixed to a surface of the first wellbore 146*a*.

In the illustrated embodiment, the portion of the system 102 further includes a downhole separator 168*a*, a first pump 170*a*, a first channel 110*b*, a first tube 172*a*, a first sensor 120*b*, a second sensor 120*f*, a control valve 124*b*, and a packer 174*a*.

The first surface separator 106 is coupled to the first pump 170*a* via the downhole separator 168*a*. The downhole separator 168*a* is coupled to the first surface separator 106 via a production tubing 194*a*, the first channel 110*b*, and the inlet manifold 114. In such embodiments, the downhole separator 168*a* is disposed downstream relative to the first pump 170*a*. In the illustrated embodiment, a motor 178*a* is disposed within the first wellbore 146*a* and configured to drive both the first pump 170*a* and the downhole separator 168*a* via a shaft 182*a*. In one embodiment, the downhole separator 168*a* is a rotary separator such as a centrifugal separator. A gas separator 206*a* is disposed between the motor 178*a* and the first pump 170*a* and configured to separate the gaseous medium 204*a* from the first production fluid 154*a* before feeding the first production fluid 154*a* to the first pump 170*a*. The packer 174*a* is disposed within the first wellbore 146*a* and located downstream relative to the downhole separator 168*a*. The first tube 172*a* is inserted through the packer 174*a* and coupled to the downhole separator 168*a*. A gas tube 208 is also inserted through the packer 174*a* and disposed around the downhole separator 168*a*. The first sensor 120*b* and the control valve 124*b* are coupled to the first channel 110*b*. The second sensor 120*f* is coupled to an outlet (not labeled) of the downhole separator 168*a*. In certain embodiments, the second sensor 120*f* may be disposed in a tube (not shown in FIG. 3) coupled to an outlet of the downhole separator 168*a*. Such a tube is used to feed the hydrocarbon rich stream 130*a* to the first surface separator 106. In one embodiment, the second sensor 120*f* is a flow sensor. In some other embodiments, the second sensor 120*f* may a pressure sensor and the like. The control unit 122 is communicatively coupled to the first sensor 120*b*, the second sensor 120*f*, the control valve 124*b*, and the motor 178*a*.

During operation, the first wellbore 146*a* receives the first production fluid 154*a* from the first production zone 156*a*. In such embodiments, the first production fluid 154*a* enters the gas separator 206*a*. The gas separator 206*a* is configured to separate the gaseous medium 204*a* from the first production fluid 154*a* before feeding the first production fluid 154*a* to the first pump 170*a*. Further, the gas separator 206*a* is configured to discharge the gaseous medium 204*a* around the downhole separator 168*a*. The motor 178*a* is configured to drive the first pump 170*a* so as to transfer the first production fluid 154*a* to the downhole separator 168*a*. The motor 178*a* is further configured to drive the downhole separator 168*a* via the shaft 182*a*. In certain embodiments, a gear box (not shown) may be disposed between the downhole separator 168*a* and the first pump 170*a* and configured to vary the speed of the shaft 182*a*. The downhole separator 168*a* is configured to generate a hydrocarbon rich stream 130*a* and a water stream 200*a* from the first production fluid 154*a*. The first surface separator 106 is configured to receive the hydrocarbon rich stream 130*a* from the downhole separator 168*a* and generate oil 134 and a water rich stream (not shown in FIG. 3). The oil outlet manifold 128 is configured to transfer the oil 134 from the first surface separator 106 to the oil tank 196.

A gas manifold 202*a* is disposed at a surface of the earth and coupled to the gas tube 208 via a wellhead 210*a*. The gas manifold 202*a* is used to discharge the gaseous medium 204*a* collected within the first wellbore 146*a* and around the downhole separator 168*a* to a discharge storage facility, a compressor, or the like. The first tube 172*a* is used to dispose the water stream 200*a* from the downhole separator 168*a* to the first disposal zone 158*a* through a plurality of perforations 212 formed in the first wellbore 146*a*. In such embodiments, the first disposal zone 158*a* is located above the first production zone 156*a*.

The first sensor 120*b* is configured to measure density of the hydrocarbon rich stream 130*a* in the first channel 110*b*. The second sensor 120*f* is configured to measure a flow rate of the hydrocarbon rich stream 130*a*. The first sensor 120*b* is configured to generate a first signal 140*b* representative of the density of the hydrocarbon rich stream 130*a*. The second sensor 120*f* is configured to generate a second signal 140*f* representative of the flow rate of the hydrocarbon rich stream 130*a*. The control unit 122 is configured to receive at least one of the first signal 140*b* and the second signal 140*f* from the first sensor 120*b* and the second sensor 120*f* respectively. In one embodiment, the control unit 122 is configured to generate the signal 142*b* to regulate the control valve 124*b* to control an outlet pressure of the hydrocarbon rich stream 130*a* flowing through the first channel 110*b* to the first surface separator 106. In some other embodiments, the control unit 122 is configured to generate a signal 142*f* for controlling a speed of the motor 178*a*. In one or more embodiments, the control unit 122 is configured to determine the amount of water content in the hydrocarbon rich stream 130*a* by comparing obtained value from the first signal 140*b* and the second signal 140*f* with predefined values stored in a look-up table, database, or the like.

Figure 4:
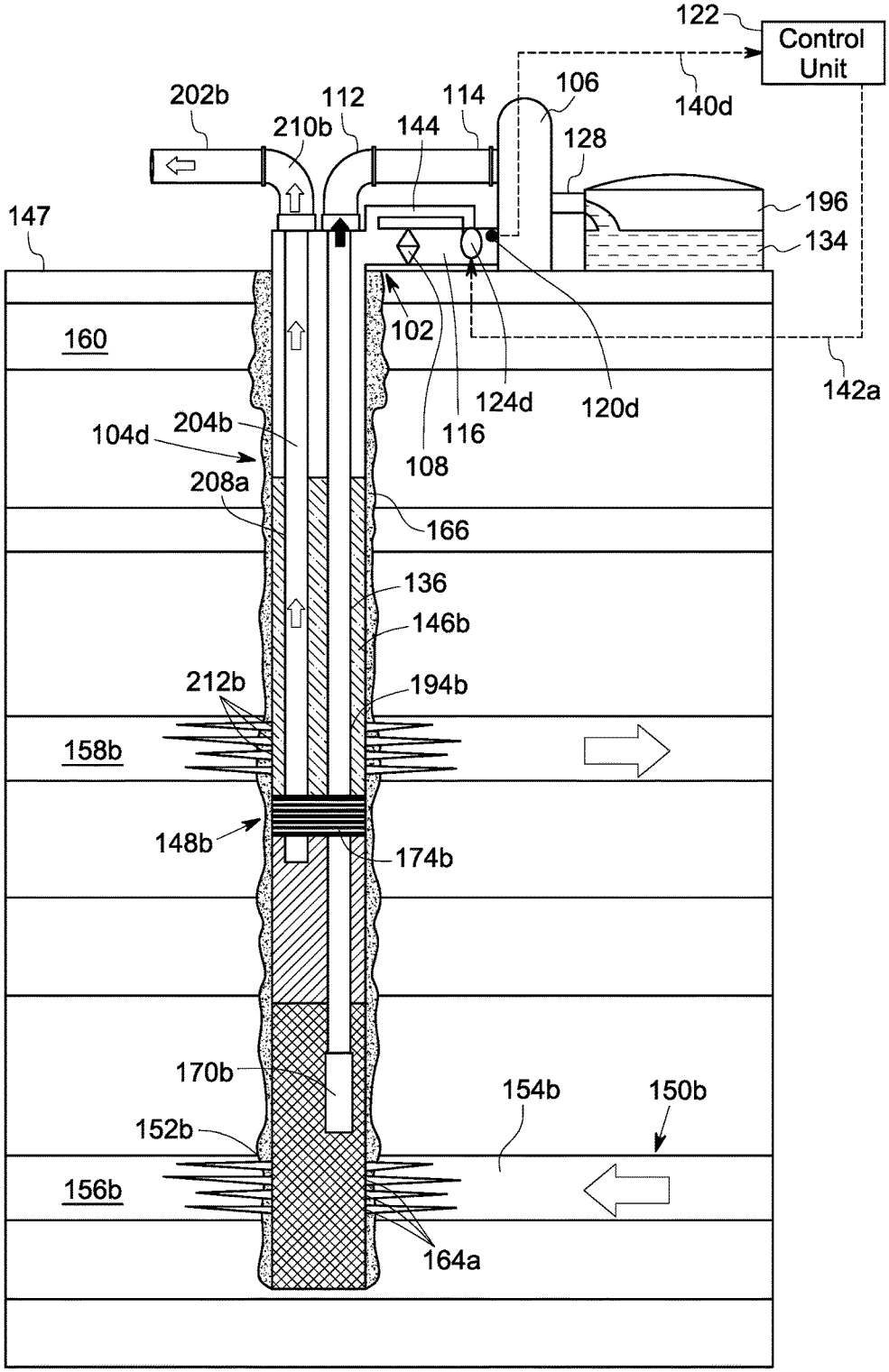
FIG. 4 is schematic diagram of yet another portion of the system disposed in a well-partition well of the plurality of wells in accordance with the exemplary embodiments of FIGS. 1 and 2.

FIG. 4 is a schematic diagram of yet another portion of the system 102 disposed in the well-partition well 104*d* in accordance with the exemplary embodiments of FIGS. 1 and 2.

The well-partition well 104*d* includes a second wellbore 146*b* drilled from the surface 147 of the earth. The second wellbore 146*b* extends up to a predetermined depth from the surface 147 to form a vertical leg 148*b*. The well-partition well 104*d* further includes a lateral leg 150*b* which is coupled to the vertical leg 148*b* via a leg junction 152*b*. The lateral leg 150*b* is used to receive a second production fluid 154*b* from a second production zone 156*b*. The well-partition well 104*d* further includes a second disposal zone 158*b* located above the second production zone 156*b*. Additionally, the well-partition well includes a water zone 160 located below the surface 147 of the earth and above the second disposal zone 158*b*. The second wellbore 146*b* includes a plurality of perforations 164*a* proximate to the leg junction 152*b* for extracting the second production fluid 154*b* from the second production zone 156*b* into the second wellbore 146*b*.

The system 102 further includes a second pump 170*b*, a packer 174*b*, and a gas tube 208*a*. The second wellbore 146*b* includes a plurality of perforations 212*b* for disposing a water rich stream 136 into the second disposal zone 158*b*.

The first surface separator 106 is directly coupled to the second pump 170*b* which is disposed within the second wellbore 146*b*. In one embodiment, the second pump 170*b* is an electrical submersible pump. In such embodiments, the second pump 170*b* may include a gas separator (not shown) configured to separate a gaseous medium 204*b* from the second production fluid 154*b* and discharge the gaseous medium 204*b* below the packer 174*b* in the second wellbore 146*b*. In some other embodiments, the second pump 170*b* may be a rod pump or the like. The well-partition well 104*d* does not include a downhole separator. The packer 174*b* is disposed within the second wellbore 146*b* and located downstream relative to the second pump 170*b*. The packer 174*b* is used to prevent mixing of the water rich stream 136 with the second production fluid 154*b*.

The production tubing 194*b* is inserted through the packer 174*a* and coupled to the second pump 170*b* and the second channel 112. Further, the gas tube 208*a* is also inserted through the packer 174*b* such that one end of the gas tube 208*a* is disposed below the packer 174*b*. A gas manifold 202*b* is disposed at the surface 147 of the earth and coupled to another end of the gas tube 208*a* via a wellhead 210*b*. The gas manifold 202*b* is configured to discharge a gaseous medium 204*b* collected within the second wellbore 146*b* to the discharge storage facility, a compressor, or the like.

During operation, the second wellbore 146*b* receives the second production fluid 154*b* from the second production zone 156*b*. In such embodiments, a motor (not shown) is used to drive the second pump 170*b* so as to transfer the second production fluid 154*b* to the first surface separator 106. The first surface separator 106 is configured generate oil 134 and water rich stream 136 from the second production fluid 154*b* and the hydrocarbon rich stream.

As discussed earlier, the control unit 122 is configured to receive a signal 140*d* representative of the density of the water rich stream 136 from the sensor 120*d* and determine an amount of oil content in the water rich stream 136. Further, the control unit 122 is configured to generate a signal 142*d* to regulate the control valve 124*d* to allow a flow of the water rich stream 136 through the second tube 116 to the second surface separator 108. In one embodiment, the control unit 122 may determine the amount of oil content in the water rich stream 136 by comparing an obtained value from the signal 140*d* with a predefined value stored in a look-up table, database, or the like.

In one embodiment, if the amount of oil content in the water rich stream 136 is below a predefined limit, the control unit 122 may bypass the water rich stream 136 via a bypass channel 144 bypassing the second surface separator. In such an example, the first surface separator 106 is configured to directly transfer the water rich stream 136 to the second disposal zone 158*b*.

In accordance with one or more embodiments discussed herein, an exemplary system and method discloses disposing water produced from a plurality of wells of a well-pad in a well-partition. Hence, the need to have a separate gathering lines, pumping equipment, or trucks for transferring the produced water away from production sites is avoided. The employment of first and second surface separators for further separation and disposal of the water rich stream facilitates the underlying downhole separator in at least one well to operate at a reasonable efficiency.

While only certain features of embodiments have been illustrated and described herein, many modifications and changes will occur to those skilled in the art. It is, therefore, to be understood that the appended embodiments are intended to cover all such modifications and changes as falling within the spirit of the invention.

The invention claimed is:

1. A system comprising:

a downhole separator disposed within a first wellbore of a well-pad and configured to receive a first production fluid from a first production zone and generate a hydrocarbon rich stream and a water stream from the first production fluid;

a plurality of pumps comprising a first pump and a second pump, wherein the first pump is disposed within the first wellbore and coupled to the downhole separator and wherein the second pump is disposed within a second wellbore of the well-pad;

a first surface separator coupled to the first pump via a first channel and to the second pump via a second channel, wherein the first surface separator is configured to receive the hydrocarbon rich stream from the downhole separator, using the first pump and a second production fluid from a second production zone, using the second pump and generate oil and a water rich stream from the hydrocarbon rich stream and the second production fluid;

a first tube coupled to the downhole separator and configured to dispose the water stream from the downhole separator into a first disposal zone via the first wellbore; and a second tube coupled to the first surface separator and configured to dispose the water rich stream from the first surface separator into a second disposal zone via the second wellbore.

2. The system of claim 1, wherein the first surface separator is directly coupled to the first pump, wherein the downhole separator is disposed upstream relative to the first pump.

3. The system of claim 2, further comprising a packer disposed within the first wellbore and upstream relative to the downhole separator, wherein the first tube is inserted through the packer and configured to dispose the water stream from the downhole separator to the first disposal zone located below the first production zone.

4. The system of claim 1, wherein the first surface separator is coupled to the first pump via the downhole separator, wherein the downhole separator is disposed downstream relative to the first pump.

5. The system of claim 4, further comprising a packer disposed within the first wellbore and downstream relative to the downhole separator, wherein the first tube is inserted through the packer and configured to dispose the water stream from the downhole separator to the first disposal zone located above the first production zone.

6. The system of claim 1, further comprising a motor disposed within the first wellbore and coupled to the downhole separator and configured to drive the downhole separator.

7. The system of claim 6, further comprising a first sensor coupled to the first channel and a second sensor coupled to an outlet of the downhole separator, wherein the first sensor is configured to measure a density of the hydrocarbon rich stream and wherein the second sensor is configured to measure a flow rate of the hydrocarbon rich stream.

8. The system of claim 7, further comprising a control unit communicatively coupled to the first sensor and the second sensor and configured to receive at least one of a first signal and a second signal from the first sensor and the second sensor respectively, wherein the first signal is representative of the density of the hydrocarbon rich stream and the second signal is representative of the flow rate of the hydrocarbon rich stream.

9. The system of claim 8, wherein the control unit is communicatively coupled to the motor and configured to control a speed of the motor based on at least one of the first signal and the second signal.

10. The system of claim 8, further comprising a control valve coupled to the first channel and communicatively coupled to the control unit, wherein the control valve is configured to control an outlet pressure of the hydrocarbon rich stream based on at least one of the first signal and the second signal.

11. The system of claim 1, further comprising a sensor coupled to the second tube and configured to measure a density of the water rich stream.

12. The system of claim 11, further comprising a control unit communicatively coupled to the sensor and configured to receive a signal representative of the density of the water rich stream.

13. The system of claim 12, further comprising a control valve and a second surface separator, wherein the control valve is coupled to the second tube and communicatively coupled to the control unit, wherein the second surface separator is coupled to the second tube, wherein the control valve is configured to transfer at least a portion of the water rich stream from the first surface separator to the second surface separator, and wherein the second surface separator is configured to generate a separated oil from at least the portion of the water rich stream.

14. The system of claim 13, further comprising a packer disposed within the second wellbore and downstream relative to the second pump, wherein the second tube is configured to dispose the water rich stream from the second surface separator to the second disposal zone located above the second production zone, wherein the packer is configured to prevent mixing of the water rich stream with the second production fluid.

15. The system of claim 13, further comprising an oil stream tube coupled to the first surface separator and the second surface separator, wherein the oil stream tube is configured to transfer the separated oil from the second surface separator to the first surface separator.

16. The system of claim 1, further comprising a jet pump disposed within the first wellbore and coupled to the downhole separator, wherein the jet pump is configured to transfer the first production fluid from the first production zone to the downhole separator.

17. The system of claim 1, wherein the downhole separator comprises a centrifugal separator.

18. The system of claim 1, wherein the downhole separator comprises a plurality of downhole separators and wherein each downhole separator is disposed within a corresponding wellbore among a plurality of wellbores of the first wellbore.

19. A method comprising:

receiving a first production fluid from a first production zone to a downhole separator disposed within a first wellbore of a well-pad;

generating a hydrocarbon rich stream and a water stream from the first production fluid, using the downhole separator;

feeding the hydrocarbon rich stream from the downhole separator, using a first pump of a plurality of pumps, to a first surface separator via a first channel, wherein the first pump is disposed within the first wellbore and coupled to the downhole separator;

feeding a second production fluid from a second production zone, using a second pump of the plurality of pumps, to the first surface separator via a second channel, wherein the second pump is disposed within a second wellbore of the well-pad;

generating oil and a water rich stream from the hydrocarbon rich stream and second production fluid, using the first surface separator;

disposing the water stream from the downhole separator into a first disposal zone via the first wellbore, using a first tube coupled to the downhole separator; and disposing the water rich stream from the first surface separator into a second disposal zone via the second wellbore, using a second tube coupled to the first surface separator.

20. The method of claim 19, further comprising driving the downhole separator, using a motor disposed within the first wellbore.

21. The method of claim 20, further comprising measuring at least one of a density of the hydrocarbon rich stream using a first sensor and a flow rate of the hydrocarbon rich stream using a second sensor, wherein the first sensor is coupled to the first channel and the second sensor is coupled to an outlet of the downhole separator.

22. The method of claim 21, further comprising controlling the motor via a control unit to control a speed of the motor based on at least one of a first signal from the first sensor and a second signal from the second sensor, wherein the first signal is representative of the density of the hydrocarbon rich stream and the second signal is representative of the flow rate of the hydrocarbon rich stream.

23. The method of claim 21, further comprising controlling a control valve via a control unit to control an outlet pressure of the hydrocarbon rich stream based on at least one of a first signal from the first sensor and a second signal from the second sensor, wherein the first signal is representative of the density of the hydrocarbon rich stream and the second signal is representative of the flow rate of the hydrocarbon rich stream, wherein the control valve is coupled to the first channel.

24. The method of claim 19, further comprising measuring a density of the water rich stream, using a sensor.

25. The method of claim 24, further comprising:

controlling a control valve via a control unit to transfer a portion of the water rich stream from the first surface separator to a second surface separator based on a signal received from the sensor, wherein the control valve is coupled to the second tube;

generating a separated oil from the portion of the water rich stream, using the second surface separator, wherein the second surface separator is coupled to the second tube; and transferring the separated oil from the second surface separator to the first surface separator via an oil stream tube.

* * * * *